United States Patent [19]

Willey et al.

[11] Patent Number: 4,458,239

[45] Date of Patent: Jul. 3, 1984

[54] FIRE EXTINGUISHING APPARATUS

[76] Inventors: Michael R. Willey, 19 Hollydale Close Reading, Berkshire,

[21] Appl. No.: 285,091

[22] PCT Filed: Nov. 14, 1980

[86] PCT No.: PCT/GB80/00197

§ 371 Date: Jul. 15, 1981

§ 102(e) Date: Jul. 15, 1981

[87] PCT Pub. No.: WO81/01369

PCT Pub. Date: May 28, 1981

[30] Foreign Application Priority Data

Nov. 15, 1979 [GB] United Kingdom ..... 7939517

[51] Int. Cl.[3] ..... G08B 21/00; A62C 37/18

[52] U.S. Cl. ..... 340/540; 340/506; 340/508; 340/510; 340/590; 340/588; 340/653; 169/23; 169/61

[58] Field of Search ..... 340/540, 506, 508, 510, 340/511, 507, 577, 588, 589, 590, 591, 652, 650, 651, 653; 169/60, 61, 28, 23

[56] References Cited

U.S. PATENT DOCUMENTS

| | | | |
|---|---|---|---|
| 2,693,240 | 11/1954 | Glendinning et al. | 169/2 |
| 3,523,583 | 8/1970 | Poitras et al. | 169/28 |
| 3,952,809 | 4/1976 | Osborne | 169/61 |
| 4,013,128 | 8/1977 | Davis | 340/590 |
| 4,101,887 | 7/1978 | Osborne | 340/540 |

*Primary Examiner*—Donnie L. Crosland

[57] ABSTRACT

A fire extinguishing apparatus and an actuating system. The actuating system includes a plurality of actuators connected in parallel and a source of electrical signal for said actuators. Each actuator is connected in parallel with a device whose resistance decreases with increasing current through the device.

3 Claims, 1 Drawing Figure

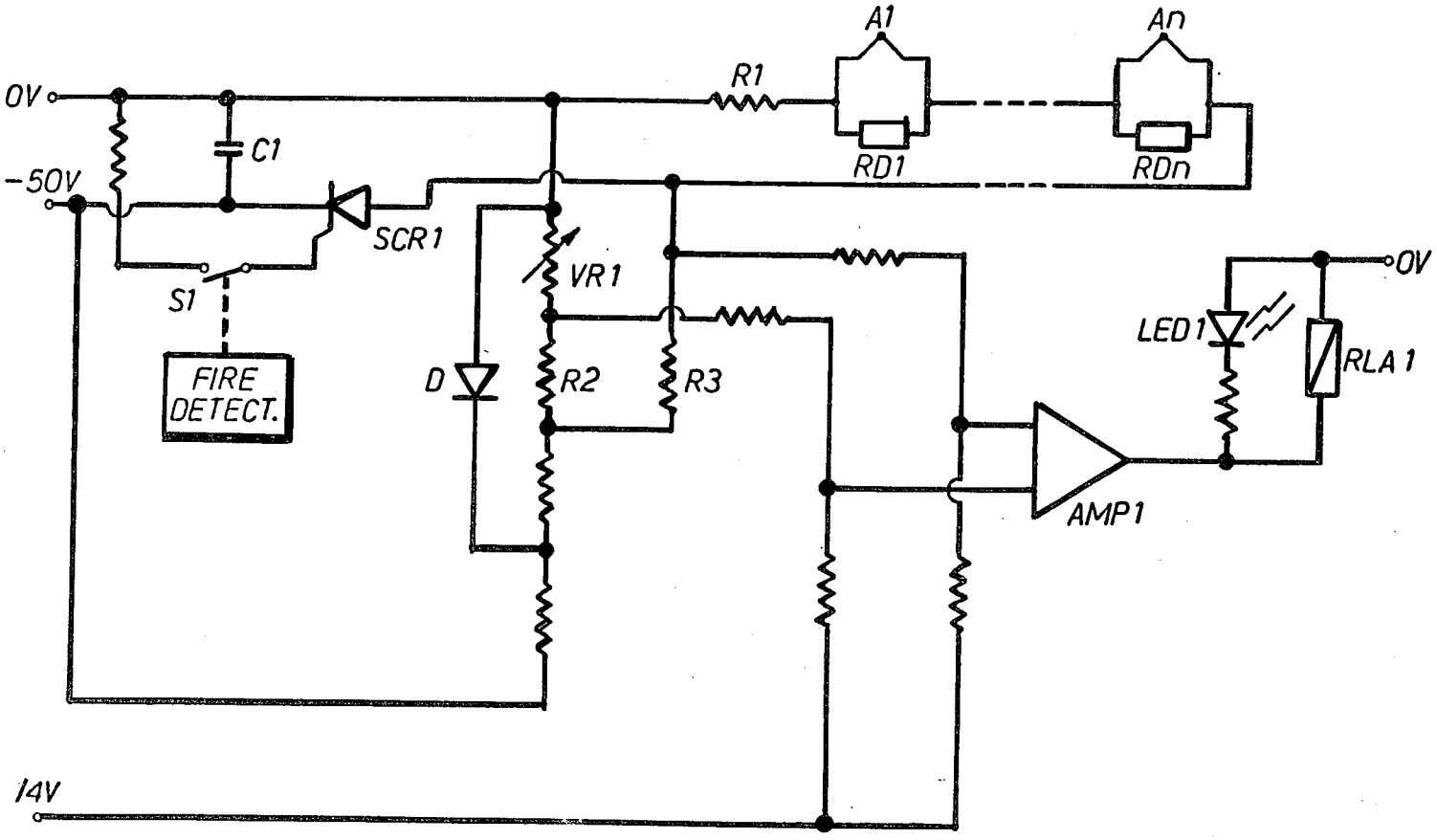
0V
RLA 1
LED1
AMP1
An
RDn
A1
RD1
R1
R3
VR1
R2
D
SCR1
C1
S1
FIRE DETECT.
0V
-50V
14V

FIRE EXTINGUISHING APPARATUS

BACKGROUND OF THE INVENTION

1. Field of the Invention

The present invention relates to fire extinguishing apparatus and more particularly to an electrical circuit for actuating fire extinguishing devices such as sprinkler heads.

2. Description of the Prior Art

One way of actuating a sprinkler head is for each head to be provided with an electrically actuable single shot actuator which is used to rupture a seal, for example the quartz bulb, of a sprinkler head to cause water or other fire extinguishing fluid to be discharged from the head. One such actuator is sold under the trade name Metron by Nobel's Explosives Company Limited of Ayshire, Scotland. Individually, these actuators operate satisfactorily but when used in large numbers and especially when it is desired to actuate a plurality of such actuators using a single trigger signal problems can arise due to the fact that when actuated the actuators can end up either in open circuit or a short circuit state in a random manner. This means that it is possible that only some of the desired number of actuators will actually be actuated which could have disasterous consequences.

In order to ensure that each actuator of a plurality of actuators is operated, one could wire the actuators in parallel but this is an expensive operation and causes difficulties in providing a trigger signal which will meet the manufacturer's specification for a drive signal which is for example, a current of 2 amps with a rise time of 100 microsecs.

Wiring the actuators in series would avoid the problems of cost and drive signal specification but does not itself solve the problem that some actuators may be in an open circuit mode after actuation and before the drive signal current can actuate any further actuators.

SUMMARY OF INVENTION

The present invention provides fire extinguishing apparatus comprising a plurality of actuators each arranged to be actuated by an electrical signal, the actuators being connected in series and arranged to be connected to a device for producing the electrical signal characterised in that each actuator has connected in parallel with it, a device whose resistance decreases with increasing current through the device.

BRIEF DESCRIPTION OF THE DRAWINGS

In order that the present invention be more readily understood, an embodiment thereof will now be described by way of example with reference to the accompanying drawing which shows a circuit diagram of a fire extinguishing arrangement according to the present invention.

DESCRIPTION OF THE PREFERRED EMBODIMENT

The apparatus comprises an electrical circuit for the operation of a number of single shot actuators (gas generators) when connected in series. Each actuator comprises a low resistance electric fuse. The actuators may be used to rupture a seal for example the quartz bulb of a sprinkler head.

The circuit utilises an electrical supply which may typically be 50 volts DC which will operate up to ten actuators in one series chain.

The supply is used to charge a capacitor (C1) which is used to reduce the effect of source impedance. The capacitor is discharged via a semi-conductor switch in the form of a silicon controlled rectifier (SCR.1) through a ballast resistor R1 into the series chain of actuators (A1-An) when it is desired to operate the actuators. The silicon controlled rectifier is triggered by the closing of a contact (S1) which may be manually and/or automatically operated by a fire detection device such as a smoke or heat detector. Across each actuator is connected a current sensitive resistance device (RD1-RDn) with typical characteristics of high resistance when passing less than 10 milliamps and low resistance when passing 2 amperes. Such a device is a Brimistor.

In order to be able to monitor the continuity of the series chain of actuators, the series chain and ballast resistor form one leg of a D.C. bridge circuit whose other legs are constituted by a variable resistor VR1 and fixed resistors $R_2$ and $R_3$. The power supply for the bridge is provided by the junction between $R_2$ and $R_3$ being connected by one pole of the D.C. supply for the actuators while the junction between the variable resistor VR1 and to series chain of actuators is connected to the other pole of the supply. A diode D is connected in parallel with the supply. Unbalancing of the bridge is detected by a liner operational amplifier AMP 1 whose one input is connected to the junction between resistance $R_3$ at the series chain of actuators and whose other input is connected to the junction between VR1 and $R_2$. The output of the amplifier is fed to an indicator in the form of a light emitting device and a relay RLA1. the light emitting device is preferably a light emitting diode LED 1.

The bridge is balanced using the variable resistor VR1 and with the bridge balanced the light emitting diode LED 1 is illuminated and the relay RLA 1 energised. Should any one of the actuators go open circuit due to aging or damage then the effective resistance of the series chain increases as the parallel resistive device is no longer shunted by the relatively low resistance of the electric fuse of the actuator. This change is sufficient to unbalance the DC Bridge and the operational amplifier switches to extinguish LED 1 (and the signalling relay is de-energised). The monitoring current flowing through the series chain is limited to less than 10 milliamps—a level which will not operate the actuators or change the value of the resistive devices. A similar indication will be given if the connecting cable in the series chain is open circuited. When actuators are connected in series *without* shunt resistive devices there is a possibility due to manufacturing tolerances and installation conditions that one electric fuse may rupture before all other fuses have reached sufficient energy to ignite their respective charges. The resistance of the actuators can vary in practice from 0.9 ohm to 1.6 ohm. Also if one or more electric fuse is open circuit the remaining 'healthy' fuses cannot be operated. With this invention in the case of a healthy chain a current in excess of 2 amperes is available with a rise time of less than 100 microseconds. If any one or more electric fuses are open circuit before or during firing then all the 'healthy' actuators may still be operated. This is due to the parallel resistive device across any open circuit electric fuse rapidly reducing its resistance with the relatively high current now flowing thereby enabling further actuators to operate. The value of the ballast resistor R1 is chosen having regard to the number of actuators in the chain and the desired magnitude of the current in the chain. Also the resistive devices will continue to conduct after operation of all actuators and it may be desired to interupt the supply either manually or by a timer or similar device after some minutes.

We claim:

1. Fire extinguishing apparatus comprising a series of components connected in series, and means for applying an electrical signal to the component at one end of said series and to the component at the other end of said series so that the signal flows through each component of said series, each component comprising an actuator and a device whose resistance decreases with increasing current through the device, said actuator and said device being connected in parallel.

2. Fire extinguishing apparatus according to claim 1 and comprising a ballast resistor connected in series with said actuators.

3. Fire extinguishing apparatus according to claim 1 or 2, and comprising means for monitoring the continuity of said series connected actuators.

* * * * *